United States Patent [19]

O'Connor

[11] 4,443,162

[45] Apr. 17, 1984

[54] FLUID PUMP

[75] Inventor: Terence A. O'Connor, Elyria, Ohio

[73] Assignee: Teledyne Republic Manufacturing, Cleveland, Ohio

[21] Appl. No.: 243,491

[22] Filed: Mar. 13, 1981

[51] Int. Cl.[3] ..... F04B 25/00

[52] U.S. Cl. ..... 417/425; 417/523

[58] Field of Search ..... 417/425, 523, 426

[56] References Cited

U.S. PATENT DOCUMENTS

| | | | |
|---|---|---|---|
| 941,587 | 11/1909 | Putnam | 417/425 X |
| 2,279,403 | 4/1942 | Kottmann | 417/425 |
| 2,678,005 | 5/1954 | Messick | 417/523 |
| 3,407,746 | 10/1968 | Johnson | 417/523 X |

*Primary Examiner*—Alan Cohan

*Attorney, Agent, or Firm*—Pearne, Gordon, Sessins McCoy, Granger & Tilberry

[57] ABSTRACT

A fluid pump having manually operable and power operable sections 10*a*, 10*b* mounted within a unitary pump body 12 that defines at least one suction and one discharge port 14, 16. The manually operated section comprises a body section 12*a* defining a bore 20*a* that slidably supports a piston 24 for reciprocating motion that includes a piston rod 24*a* that extends outside of the body section and is operatively connected to an actuatable arm 60 pivotally atttached to the pump body. Flow passages 34, 42 including a check valve 32 communicate the suction port 14 with one portion 20*a* of the piston bore; another flow passage 49 communicates a discharge side 20*b* of the piston bore with the discharge port. The power operable pump section comprises another pump body section 12*b* that defines a pair of axially aligned bores 82 that slidably support pistons 80 and an eccentric 84 including a drive shaft 130 rotatably mounted within the pump body disposed intermediate and operatively engageable with the pistons. Rotation of the eccentric produces reciprocating motion in the pistons and effects fluid transfer from an inlet chamber 88 to the discharge port 16 by way of fluid passages 156, 158 formed within the pump body each including a check valve 87. The drive shaft includes structure 170 engageable by an external source of powered rotation.

7 Claims, 6 Drawing Figures

FLUID PUMP

DESCRIPTION

Technical Field

The present invention relates generally to fluid pumps, and in particular to a fluid pump assembly having both power operable and hand operable pump sections.

BACKGROUND ART

Hand operated, high pressure fluid pumps are used in many applications, often acting as backup pumps in systems that employ power driven pumps as a source of fluid pressure. An emergency engine starting system for military aircraft is one such application. Some aircraft jet engines are started by a fluid motor connected to and operated by fluid pressure stored in an accumulator. The stored pressure is usually 3000 psi or higher. In normal operation, the accumulator is pressurized by the aircraft engine prior to shutdown thus providing a subsequent source of starting energy.

In some instances, the accumulator will become depressurized as a result of maintenance work on the engine, system failure, etc. If the aircraft is located at a fully equipped aircraft base, auxiliary equipment is usually available to start the engine. However, if the aircraft is located in a more remote area where only limited service equipment is available, apparatus for repressurizing the accumulator in order to start the engine must be provided on the aircraft itself.

In the past, this auxiliary apparatus has been a hand operated fluid pump mounted within the aircraft. In the event the accumulator was depressurized, an operating handle was reciprocated to actuate the hand pump to force fluid into the accumulator. It was found, however, that considerable effort and more importantly, a considerable amount of time was expended in completely charging the accumulator. In an emergency situation, the time necessary to start the engine could be detrimental.

It was also found that in many remote areas served by the aircraft, auxiliary power sources such as pneumatically operated tools were available. Consequently, a means for utilizing these limited power sources to aid in charging the accumulator was desired. A separate, power operable pump was considered, but was precluded due to space limitations on the aircraft. The separate power operable pump could not eliminate the hand operated pump currently mounted on the aircraft because a manually actuated pump must be provided on each aircraft to enable the aircraft to be started in areas devoid of any source of power.

DISCLOSURE OF INVENTION

The present invention provides a new and improved fluid pump assembly that includes a manual operable and power operable pump in a relatively small package and preferably in an integral pump body.

In the preferred embodiment, the fluid pump assembly includes a pump body defining at least one suction and one discharge port and further defining integrated first and second pump sections. The first section forms a hand operable pump and includes a pumping chamber defined by a cylindrical bore and a piston slidably disposed within the chamber and operatively connected to an operating handle through a piston rod. The handle is pivotally mounted to the pump body and includes suitable linkage connecting the handle with the piston. Reciprocation of the handle produces a reciprocating, pumping motion of the piston which draws fluid from the suction port by means of a passage that communicates the port with the pump chamber and forces the fluid to the discharge port which communicates with the pump chamber through another fluid passage, both passages being defined by the pump body. In the preferred construction, the piston includes a fluid passage that communicates opposite ends of the piston and a check valve mounted within the piston which allows fluid flow through the piston in only one direction. The suction and discharge ports communicate with the opposite ends of the piston bore and fluid flow between the ports occurs through the piston.

The second section of the pump body forms a power operable pump that preferably communicates with the suction and discharge ports through passages formed within the pump housing. In the preferred embodiment, the power operable pump section is cam driven and includes a drive shaft which extends outside of the pump body that is engageable with a source of powered rotation, such as a pneumatic tool. By coupling a suitable source of power to the shaft, the second pump section is actuated to draw fluid from the suction port and transfer it to the discharge port without the need for disabling or otherwise modifying the hand operable pump section. In the disclosed embodiment, the operation of either pump will transfer fluid from the suction to the discharge port without the need for operator action to either enable or disable the idle pump section.

In the preferred embodiment, the power operable pump comprises a pair of pistons slidably disposed in a pair of axially aligned bores. The outer ends of the bores communicate with the discharge port through associated check valves which allow fluid flow from the bores to the discharge port but prevent reverse flow. An ecentrically driven cam located within a fluid inlet chamber is disposed between the pistons and is connected to the drive shaft which extends outside of the pump body. The pistons are biased into abutting engagement with a cam surface on the eccentric by springs which act between the outer ends of the bores and the pistons. Rotation of the eccentric in combination with the piston springs, causes the pistons to reciprocate within their associated bores.

In the preferred embodiment, each piston includes a flow passage extending between opposite ends of the piston and a check valve which allows unidirectional fluid flow from the inlet chamber to the outer ends of the bores. Fluid at the suction port is communicated to the inlet chamber by a passage formed in the pump body. Rotation of the eccentric drives the pistons thereby transferring fluid from the inlet chamber to the discharge ports by way of the flow passages and check valves located within the pistons and by way of the flow passages and check valves that communicate the outer ends of the cylinder bores with the discharge port.

The disclosed pump assembly is especially suited for aircraft applications for its overall size is not much greater than the size of the hand operated pump currently in use. More importantly, either pump section can be operated without the need for disabling or isolating the other pump section. Actuation of either pump will produce fluid flow from the suction port to the discharge port.

Although the invention has been described in connection with starting systems on military aircraft, the disclosed fluid pump has other uses including uses in both military and non-military environments. The pump can be used in any application in which a backup pump that can be either manually or power operated is needed. One such application might be in a lift truck or hydraulic conveyor system where it might be desirable to provide an emergency backup system for the primary fluid pump.

A fuller understanding and additional features of the invention will be obtained in reading the following detailed description made in connection with the accompanying drawings.

BEST MODE FOR CARRYING OUT THE INVENTION

Figure 1:
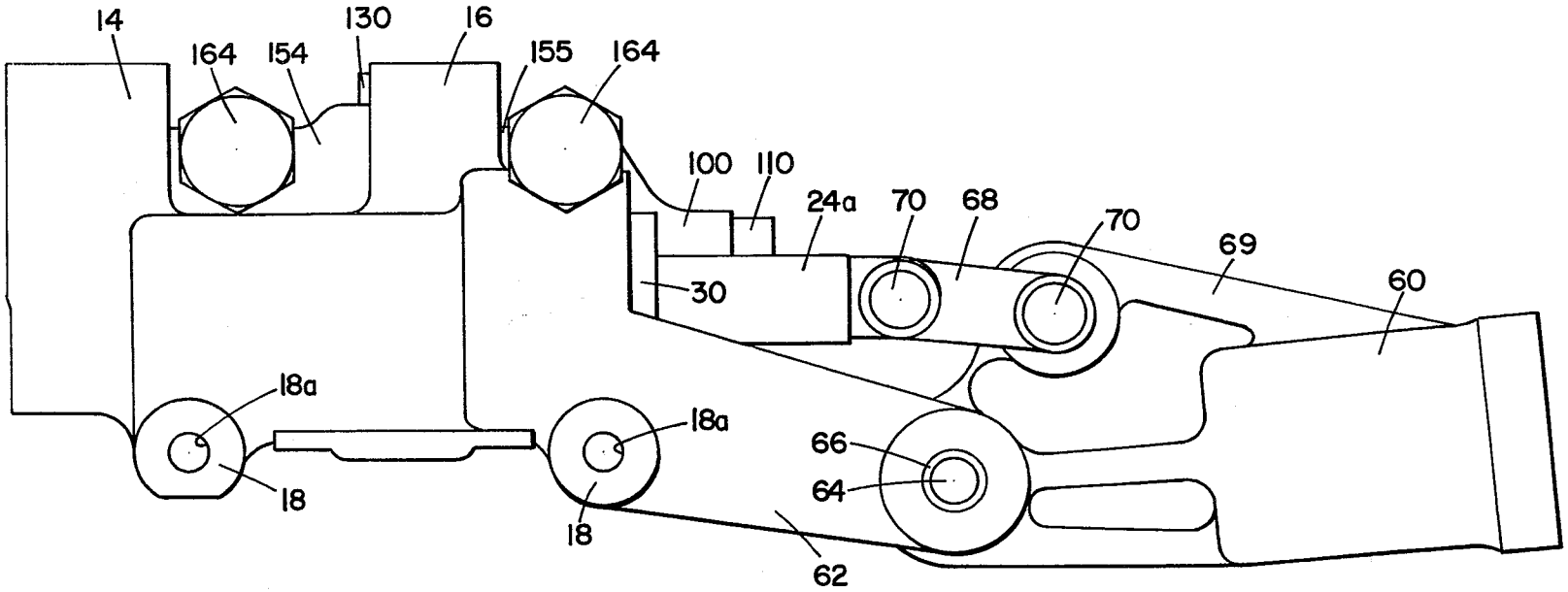
FIG. 1 is a side elevational view of a pump assembly constructed in accordance with the preferred embodiment of the invention.
Figure 2:
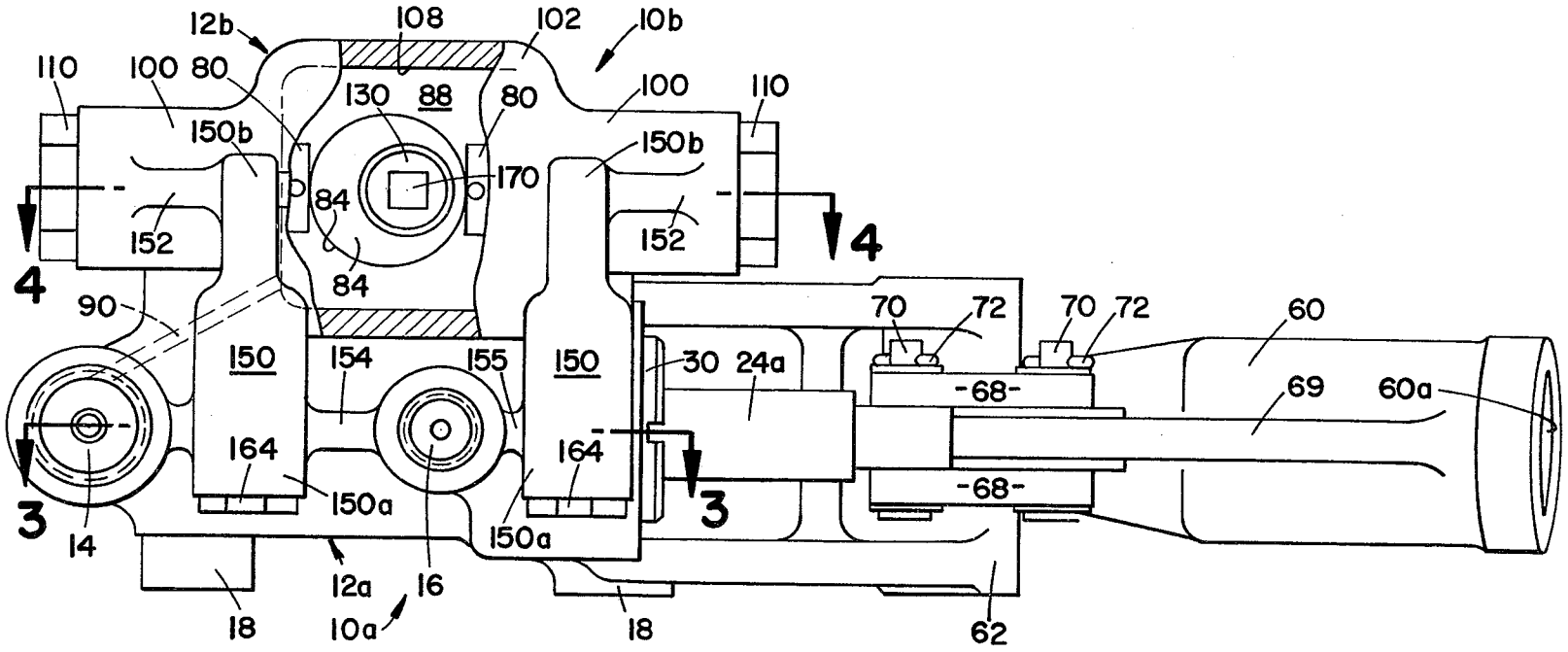
FIG. 2 is a top plan view of the pump assembly with portions broken away to show interior detail.

FIGS. 1 and 2 illustrate the overall construction of a pump assembly embodying the present invention having a manually operable section 10*a* and a power operable section 10*b*. The assembly includes a pump body 12 preferably formed by an integral casting with respective pump body sections 12*a*, 12*b* oriented in a juxtaposed fashion. At least one suction and one discharge port 14, 16 are defined by the pump body 12, each port including internally threaded ends (shown in FIG. 3) to which conduit connections are made. Mounting bosses 18 including apertures 18*a* are also defined by the pump body 12.

Figure 3:
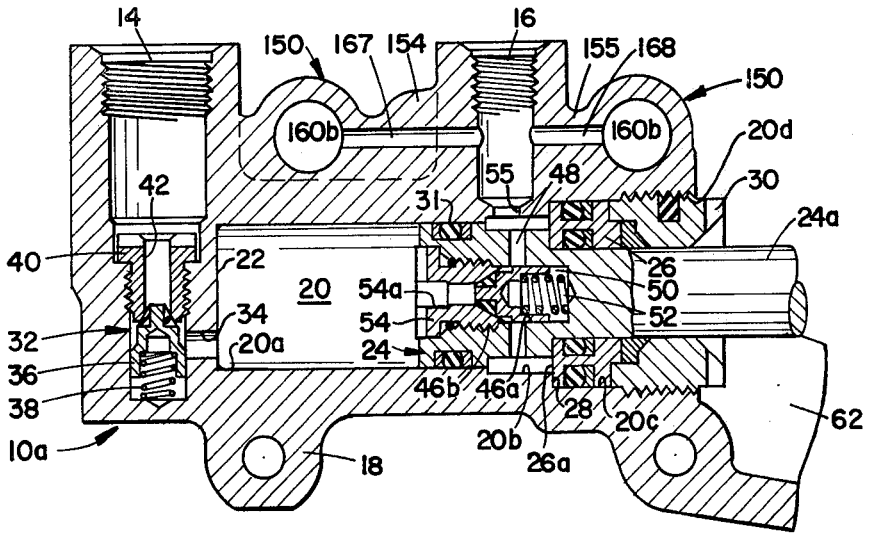
FIG. 3 is a fragmentary, sectional view of the pump assembly as seen from the plane indicated by the line 3—3 in FIG. 2.

The manually operated section 10*a* is substantially conventional in construction. Referring in particular to FIG. 3, a stepped cylindrical bore 20 extends laterally from the right side of the body section 12*a* (as viewed in FIG. 3) and terminates at an end wall 22. The bore 20 includes a uniform diameter portion defining a piston chamber 20*a*, enlarged diameter stepped-portions 20*b*, 20*c* and a threaded portion 20*d*. A piston 24 is slidably disposed within the bore portion 20*a* and includes an integrally formed piston rod 24*a* that extends outside of the pump section 10*a*. A seal assembly 26 sealingly engages the piston rod 24*a* and the bore portion 20*c* to prevent fluid leakage out of the bore 20 and is held against a step 28 by a threaded seal retainer 30 that threadedly engages the threaded portion 20*d* of the bore 20. The end wall 22 and an inner radial wall 26*a* of the seal assembly 26 define the limits of movement for the piston 24. The piston carries a fluid seal assembly 31 that sealingly engages the piston chamber 20*a*.

Reciprocation of the piston 24 in the piston chamber 20*a* conveys fluid from the suction port 14 to the discharge port 16. The suction port 14 communicates with the bore 20 through a check valve 32 located coaxially with the suction port and a relatively small diameter connecting passage 34. As shown in FIG. 3, the check valve 32 comprises a poppet 36 biased upwardly by a resilient spring 38 into seating engagement with a threaded valve seat 40 that includes a central bore 42. During the suction stroke of the piston 24, i.e., piston movement towards the right as viewed in FIG. 3, the check valve 36 opens and allows fluid flow to proceed from the suction port 14 to the bore portion 20*a* by way of the bore 42 and the passage 34. During the reverse or discharge stroke, i.e, piston movement towards the left, the check valve prevents fluid flow from the bore 20 to the suction port 14.

In the preferred embodiment, the piston 24 includes a check valve that allows fluid flow through the piston as it travels towards the end wall 22. In particular, the piston 24 includes an axially positioned bore that includes a reduced, uniform diameter portion 46*a* and a threaded portion 46*b*. A diametral bore 48 extends through and communicates the piston bore portion 46*a* with the piston bore portion 20*b*. A poppet valve 50 biased towards the left (as viewed in FIG. 3) by a spring 52 is located in the bore portion 46*a* by a valve seat 54 that threadedly engages the threaded bore portion 46*b* and includes a stepped central bore 54*a*. As seen in FIG. 3, the check valve 50 allows fluid flow to proceed unimpeded from the valve seat bore 54*a* to the diametral bore 48 but prevents reverse flow. As the piston is driven from the position shown in FIG. 3 towards the end wall 22, fluid in the piston chamber 20*a* passes from the left to the right side of the piston. In other words, fluid is transferred through the piston from the bore portion 20*a* to the bore portion 20*b*. The bore portion 20*b* communicates with the discharge port 16 through a short, drilled passage 55 and the fluid transferred to the bore portion 20*b* is eventually forced out the discharge port 16 (as the piston 24 moves towards the inner radial wall 26*a*).

Figure 6:
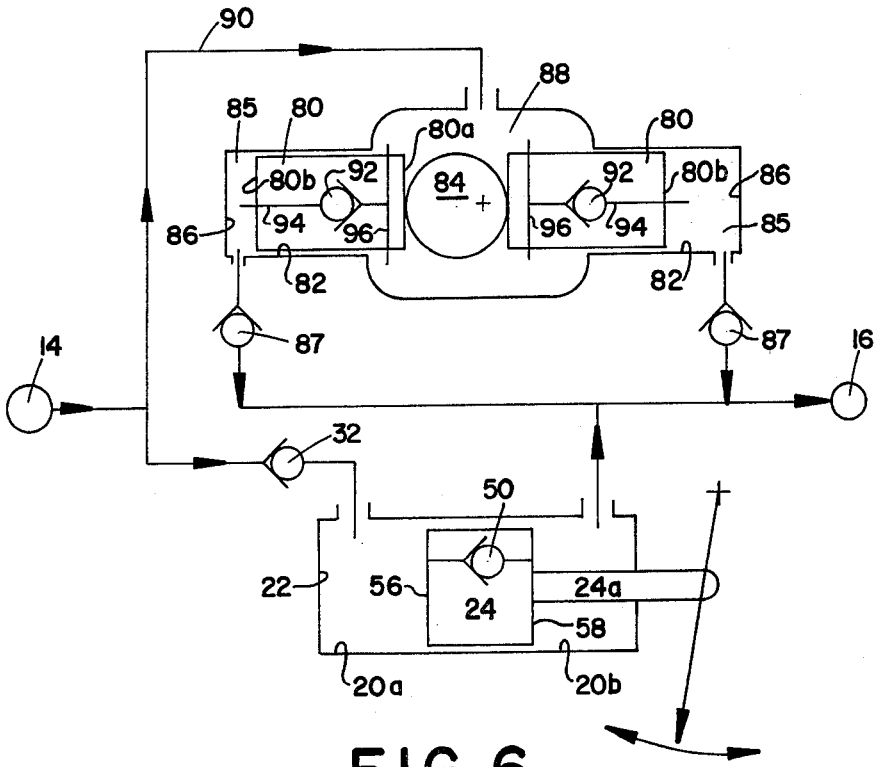

The overall operation of the pump section 10*a* is best seen in FIG. 6. As shown schematically, fluid at the suction portion 14 is drawn into the bore portion 20*a* through the check valve 32 as the piston 24 moves towards the right. On the return stroke, the piston moves from the right to the left as viewed in FIG. 6. Fluid trapped between the end wall 22 and the left radial face 56 of the piston 24 is transferred to the bore portion 20*b*, i.e., between the right face 58 of the piston and the seal assembly radial surface 26*a*, via the check valve 50 and associated fluid passages. On the subsequent suction stroke, the fluid trapped in the bore portion 20*b* is forced out through the discharge port 16.

Returning to FIGS. 1 and 2, the piston 24 is reciprocated within the piston chamber 20*a* by an arm 60 pivotally attached to the pump housing at a pivot point defined near the end of an integrally formed housing extension 62. A pin 64 and bushings 66 (only one bushing is shown) pivotally couple the arm 60 to the housing extension 62. The arm 60 includes a socket 60*a* (shown best in FIG. 5) adapted to receive an operating handle (not shown). A pair of connecting links 68 connect the right end of the piston rod 24*a* with a vertically extending web portion 69 located on the arm 60 and spaced from the pivot point. A pair of pivot pins 70, retained in position by cotter pins 72 couple the links to the piston rod 24*a* and the arm 60. Pivotal pumping motion in the arm 60 thus produces rectilinear reciprocating movement in the piston 24.

The pump body section 12b houses the power operable pump section 10b which, in the preferred embodiment, comprises an eccentrically driven dual piston pump. The operation of the pump is best explained with reference first to the schematic representation illustrated in FIG. 6. A pair of pistons 80 are slidably disposed in a pair of piston bores 82 and are reciprocally driven therein by an eccentric 84 disposed intermediate inner end faces 80a of each piston 80. Discharge chambers 85 are defined between the outer end faces 80b of the pistons and end walls 86 located at the outer ends of the bores 82. Each discharge chamber 85 communicates with the discharge port 16 through an associated check valve 87 that prevents fluid flow from the discharge port 16 to the chambers 85. The eccentric 84 and the inner end faces 80a of the pistons 80 are located within an inner chamber 88 defined by the pump body portion 12b that forms a fluid inlet chamber. The inlet chamber 88 communicates with the suction port 14 by means of a fluid passage 90. Each piston 80 includes a check valve 92 disposed in an axial fluid passage 94. A diametral fluid passage 96 formed in each piston 80 communicates the passages 94 with the inlet chamber 88. The check valves 92 are operative to allow fluid flow from the inlet chamber 88 to the discharge chambers 85 but prevent reverse flow. In the configuration shown, rotation of the eccentric 84 imparts concurrent reciprocating motion to the pistons 80.

The pump section 10b operates as follows. As a piston 80 is driven by the cam 84 towards the end wall 86, fluid trapped between the piston and the end wall is forced out of the chamber 85 through the associated check valve 87 that communicates with the discharge port 16. On the return stroke, i.e., as a piston 80 moves towards the inlet chamber 88, fluid in the inlet chamber 88 is transferred through the piston 80, via the check valve 92 to the associated discharge chamber 85. The transferred fluid is forced out of the discharge chamber 85 to the discharge port 16 on the subsequent stroke of the piston 80. Both pistons 80 operate in an identical manner and it should be appreciated that in the configuration shown, one piston is moving in the discharge direction while the other is moving in the suction direction at any given point in operation.

Figure 5:
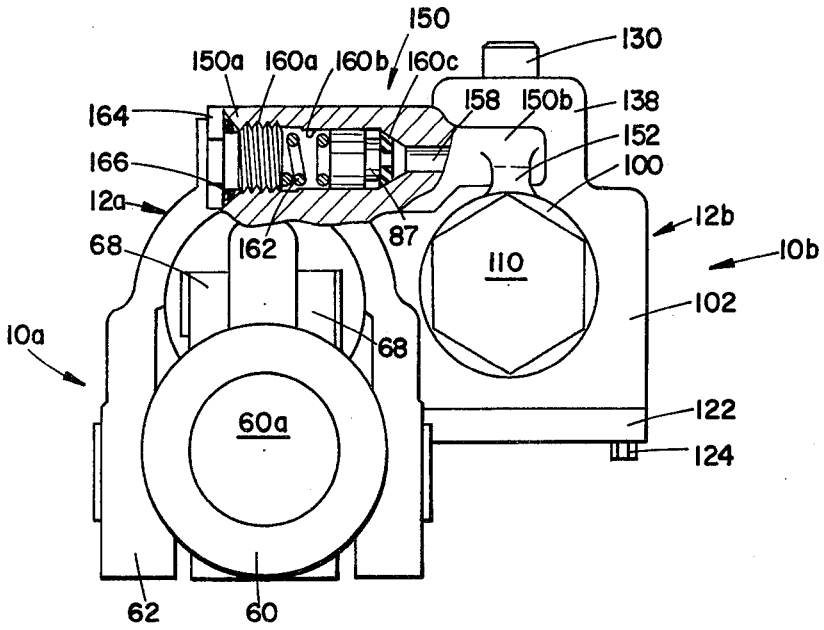
FIG. 5 is an end view of the pump assembly, partially in section as seen from the plane indicated by the line 5—5 in FIG. 4; and, FIG. 6 is a schematic representation of the fluid pump assembly.
Figure 4:
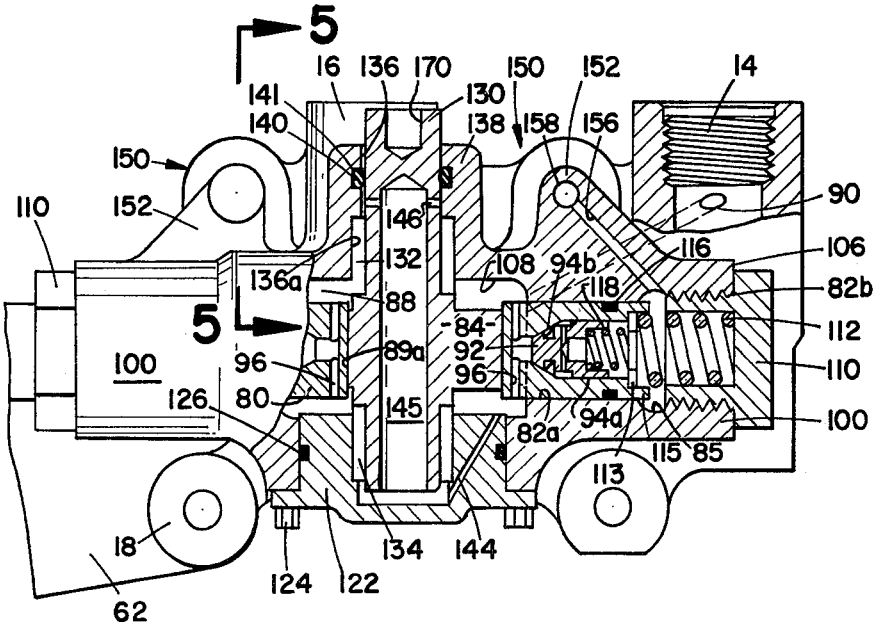
FIG. 4 is a fragmentary view, partially in section, as seen from the plane indicated by the line 4—4 in FIG. 2.

The preferred construction of the power operable pump section 10b is shown in FIGS. 2, 4 and 5. As seen in FIG. 2, the pump body section 12b defines a pair of cylindrical portions 100 formed on either side of an enlarged region 102. As seen in FIG. 4, the cylindrical portions 100 each define a piston bore (element 82 in FIG. 6) that extends from an outer end face 106 of the casting to a cavity 108 formed in the interior of the body section 12b. Each piston bore includes a uniform diameter portion 82a that slidably receives a piston 80, a narrow, enlarged diameter portion that defines the discharge chamber 85 and a threaded section 82b near the outer end that threadedly receives a plug 110 that caps the outer end of the piston bore and also serves as a spring seat for a spring 112 that biases the piston 80 towards a cam surface 84a on the eccentric 84. Each spring 112 acts between the plug 110 and an apertured washer 113 that rests against an inner, recessed shoulder 115 formed in each piston 80. Each piston carries an O-ring seal 116 that sealingly engages the piston bore portion 82a.

As previously discussed, each piston 80 includes an axial fluid passage 94 (shown in FIG. 6) that intersects a diametral fluid passage 96. As seen in FIG. 4, the axial fluid passage includes a uniform diameter portion 94a that slidably supports the check valve 92 and a tapered portion 94b that serves as a valve seat for the check valve. A biasing spring 118 acting between the apertured washer 113 and the check valve 92 biases the valve towards seating engagement. The check valve 92 is operative to allow fluid flow from the cavity 108 through the piston (via fluid pasages 96, 94b) but prevents reverse flow, i.e., fluid flow from the discharge chamber 85 to the cavity 108.

Referring to FIG. 4, the inlet chamber 88 (shown schematically in FIG. 6) is defined by the cavity 108 formed in the enlarged body region 102, and a cover 122 that encloses the cavity 108. The cover 122 is suitably atached to the pump body section 12b by fasteners 124. An O-ring seal 126 carried by the cover 122 prevents fluid leakage from the inlet chamber 88.

The eccentric 84 is preferably integrally formed with a shaft 130 that is rotatably supported within the pump section 10b by upper and lower bushings 132, 134. The upper part of the shaft 130 (as viewed in FIG. 4) extends through a bore 136 machined into a boss 138 formed in the pump body casting. An internal seal ring 140 located in an O-ring groove 141 sealingly engages the shaft and prevents fluid leakage from the inlet chamber 88. The upper bushing 132 is press fitted into an enlarged diameter portion 136a of the bore 136. The lower bushing 134 is press fitted into the cover 122 that is fastened to the bottom of the body section 10b. A short, narrow fluid passage 144 formed in the cover 122 communicates fluid pressure from the inlet chamber 88 to the bushing 134. In the preferred embodiment, the shaft 130 includes an axial bore 145 extending from the bottom of the shaft (as viewed in FIG. 4) to a pair of diametrically positioned bores 146, located near the upper end of the shaft 130 and serves to lubricate the upper bushing 132 and the seal 140.

As seen in FIGS. 2, 3 and 4, the fluid passage 90 (shown schematically in FIG. 6) is preferably drilled into the body section 12b and extends from the suction port 14 to the inlet chamber 88.

Returning to FIGS. 1 and 2, a pair of check valve housings 150, each having large and small diameter proportions 150a, 150b, are located on top of the pump body 12 (as viewed in FIG. 1) and extend between the pump body sections 12a, 12b and preferably form part of the pump body casting. As seen in FIG. 2, webs 152 join the small diameter portions 150b with the cylindrical pump body portions 100. Webs 154, 155 extend between the sides of the large diameter housing portions 150a and the discharge port 16.

Referring to FIG. 4, a relatively narrow, angled passage 156 drilled in each connecting web 152 communicates each discharge chamber 85 with an axial fluid passage 158 machined in the small diameter portion 150b of each check valve housing 50. Referring also to FIG. 5, each check valve housing 150 defines a multistep bore including a threaded portion 160a, a uniform diameter portion 160b, and a tapered portion 160c that defines a valve seat and which merges into the fluid passage 158. Each having 150 mounts a check valve 87 (shown schematically in FIG. 6) that comprises a poppet valve biased towards seating engagement with the valve seat 160c by a biasing spring 162. The threaded portion 160a of the bore 160 threadedly receives a retaining plug 164 that also serves as a spring seat for the spring 162. A seal 166 prevents fluid leakage out of the bore 160a. The bore portions 160b of the respective check valve housings 150, communicate with the discharge port 16 through fluid passages 167, 168 formed in the webs 154, 155, respectively.

In operation, each check valve 87 allows relatively unimpeded fluid flow from its associated discharge chamber 85 to the discharge port 16 (by way of the flow passages 156, 158, 167, 168). The check valves 87 prevent fluid flow from the discharge port 16 to the piston discharge chambers 85. In essence, the check valves isolate the power operable pump from the discharge port so that the pump sections 10*a*, 10*b* can be operated independently of each other without the need for isolating or disabling the idle pump section.

According to the invention, a means for connecting the shaft 130 to a suitable power source such as a pneumatically operated power tool is provided. In the preferred embodiment, it takes the form of a polygonal shaped socket 170 formed at the top of the shaft 130 (see FIG. 4). Rotative coupling is achieved by the insertion of a complementary shaped projection forming part of the power source such as a shaft having a square cross-section. In use, the power tool is coupled to the shaft 130 and then energized. Rotation of the shaft 130 rotates the eccentric 84 and produces reciprocating motion in the pistons 80. When the pistons are driven towards the end caps 110, fluid trapped between the outer end face 80*b* of the piston 80 and the plug 110 is driven into the check valve housing 150 through the fluid passages 156, 158. On the return stroke, the piston 80 is driven towards the eccentric 84 by the spring 112 and fluid is transferred from the inlet chamber 88 to the discharge chamber 85, through the piston 80.

The disclosed fluid pump provides a manually operable and power operable fluid pump in a unitary package. Each pump, although communicating with the same suction and discharge ports formed on the valve body, operate independently of each other and do not require separate operator action to disable or isolate the idle pump section. Due to size advantages, the power operable pump section preferably comprises the dual piston, cam operated pump described above. Other power operable pump configurations are contemplated by the present invention such as power actuatable single piston reciprocating pumps. Additionally, the socket 170 can be replaced by a variety of other coupling structures such as, but not limited to knurled fittings, male socket drives, etc., all such configurations being contemplated herein.

Although the invention has been described with a certain degree of particularity, it is understood that various changes can be made to it without departing from the spirit or scope of the invention as described and hereinafter claimed:

1. A pump assembly, comprising:

(a) an integral pump body defining at least one suction and one discharge port;

(b) a manually operable pump section including a pump body section defining a longitudinal bore;

(c) a piston member slidably supported for reciprocating motion by said bore, said member including a piston rod extending outside of said bore and operatively connected to a manually actuatable arm pivotally attached to said pump body section;

(d) a first flow path including a check valve communicating one portion of said bore with said suction port;

(e) a second flow path communicating another portion of said bore with said discharge port;

(f) check valve means carried by said piston, operative to allow fluid flow from said one portion to said other portion of said bore;

(g) a power operable pump forming part of said fluid pump assembly, including another pump body section, said other body section defining a pair of axially aligned bores, the inner ends of said bores communicating with a fluid inlet chamber defined in said other body section;

(h) a piston supported for sliding, reciprocating movement in each bore, each piston carrying a check valve operative to allow fluid flow through each piston from said inlet chamber to the outer ends of each bore;

(i) passage means including check valve means communicating said outer ends of each bore with said discharge port;

(j) piston drive means including an eccentric cam located within said inlet chamber and disposed intermediate said pistons;

(k) said piston drive means including a rotatable drive shaft extending outside of said other pump body section and engageable with a source of powered rotation, the axes of said bores being contained in a plane, said rotatable drive shaft extending substantially perpendicular to said plane.

2. A fluid pump comprising a unitary body, a first longitudinal bore in said body, a second longitudinal bore in said body substantially parallel to said first bore and closely adjacent thereto, a suction port and a discharge port in said body, manually operable, double-acting first pistion means in said first bore providing a piston rod extending outside said body for producing manual reciprocation of said first piston means, single-acting second and third opposed piston means reciprocable in said second bore, a rotary power drive located between said second and third piston means operable to produce reciprocation thereof, first passage means connecting said suction port to one side of each of said piston means and providing a check valve between only said first piston means and said suction port, second passage means connecting the other side of each piston means and said discharge port and providing check valves only between each of said second and third piston means and said discharge port, pumping operation of said first piston means being unable to produce movement of said second and third piston means, pumping operation of said second and third piston means being unable to produce movement of said first piston means.

3. The fluid pump of claim 2 wherein said pump body comprises a unitary casting.

4. The fluid pump assembly of claim 2 wherein said drive means includes an eccentric cam engageable with said second piston means.

5. A pump as set forth in claim 2, wherein the axes of said first and second bores are contained in a first plane, said rotary power drive includes a drive shaft extending substantially perpendicular to said first plane, and a manual drive link is pivoted on said body for movement in a second plane substantially perpendicular to said first plane and is connected to reciprocate said piston rod in response to pivotal movement thereof.

6. A pump as set forth in claim 5, wherein said drive shaft includes a polygon-shaped axial portion at one end for receiving a complementary shaped part of a source of powered rotation.

7. A pump as set forth in claim 1, wherein said second flow path is free of check valves, whereby said another portion of said bore is maintained at the pressure of said discharge port, said check valve in said first flow path preventing movement of said piston member of said manually operable pump section resulting from pressure produced by said power operated pump.

* * * * *

UNITED STATES PATENT AND TRADEMARK OFFICE

CERTIFICATE OF CORRECTION

PATENT NO. : 4,443,162

DATED : April 17, 1984

INVENTOR(S) : Terence A. O'Connor

It is certified that error appears in the above-identified patent and that said Letters Patent are hereby corrected as shown below:

On first page,
References Cited: Attorney, Agent, or Firm--
should read: Pearne, Gordon, Sessions,
McCoy, Granger & Tilberry not: "Sessins"

Abstract: column 2, line 9, "49" should read "48".

Column 6, line 61, "having" should read "housing".

Claims: column 8, line 28, "pistion" should read "piston".

Column 8, line 49, "and third" needs to be inserted after the word "second".

Signed and Sealed this

*Eleventh* Day of *September 1984*

[SEAL]

*Attest:*

GERALD J. MOSSINGHOFF

*Attesting Officer*

*Commissioner of Patents and Trademarks*